US006058810A

United States Patent [19]

Junkers

[11] Patent Number: 6,058,810

[45] Date of Patent: May 9, 2000

[54] POWER TOOL FOR AND A METHOD OF MOVING AN ELEMENT RELATIVE TO AN OBJECT

[76] Inventor: John K. Junkers, 7 Arrowhead La., Saddle River, N.J. 07540

[21] Appl. No.: 09/187,788

[22] Filed: Nov. 7, 1998

[51] Int. Cl.[7] ..... B25B 21/00

[52] U.S. Cl. ..... 81/56; 81/53.2; 254/29 A

[58] Field of Search ..... 81/56, 57.11, 57.42, 81/436, 53.2, 429, 57.38, 57.39; 254/29 A; 411/432

[56] References Cited

U.S. PATENT DOCUMENTS

Re. 33,490 12/1990 Steinbock .

*Primary Examiner*—David A. Scherbel
*Assistant Examiner*—Hadi Shakeri
*Attorney, Agent, or Firm*—Michael J. Striker

[57] ABSTRACT

For moving an element in an axial direction relative to an object, a plurality of screw members are screwable in the element and are arranged around an axis so as to be spaced from one another, each of the screw members has a first end adapted to interact with the object and an opposite second end, and a drive unit includes an action drive and a reaction drive arranged coaxially to the axis and with one another and turnable in opposite directions, one of the drives engages an outer circumference of the screw members while the other drives engages an inner circumference of the screw members so that when the power tool is activated the drives are turned in opposite directions and turn the screw members in one and the same direction to thereby move the element in the axial direction.

9 Claims, 3 Drawing Sheets

POWER TOOL FOR AND A METHOD OF MOVING AN ELEMENT RELATIVE TO AN OBJECT

BACKGROUND OF THE INVENTION

The present invention relates to power tools for and methods of moving elements relative to an object, for example for moving a nut which is screwed on a bolt, a head of a bolt, etc.

Power tools of the above mentioned general type are known in the art. Known power driven torque tools have an action and an opposite reaction force. The action force is usually exerted by a drive member adapted to turn an element. The reaction force is usually transferred to an object adjacent to the element to be turned, by means of a reaction bar. The reaction bar is usually connected to the tool housing. This way only one of the two opposite forces is being used.

A power tool for this purpose is disclosed in my U.S. Pat. No. 5,499,558. The tool has a coaxial action and reaction, and corresponding action and reaction applying parts. However, only one of them turns while the other stands still. It does not provide application of opposite turning forces of a power tool action and reaction simultaneously to one or several members, so as to turn them in the same direction.

My U.S. patent application Ser. No. 08/957,618 discloses a nut member having a plurality of geared screw members screwed into it. FIG. 3 shows an embodiment for turning the screws simultaneously by applying a turning force to the outer circumference of the gears, while FIG. 4 shows an embodiment for turning the screws simultaneously by applying a turning force to the inner circumference of the gears.

In the known power tools of this type there are three negative forces than can act when a bolt etc is stretched via a torque: a side load, a bending force and a torsion. If a torque wrench is used and only one drive is applied to turn the screws, three things can occur:

- the tool would have to react against a nearby stationary object, causing a side load to the ring member;
- if the turning friction of the screws exceeds the friction of the abutment of one end of the screw members, the ring-type member could turn causing torsion;
- if the gear head of one screw bends slightly and skips the tooth engagement, then the screw would not extend equally with the others causing a bending force of the ring-type member.

SUMMARY OF THE INVENTION

Accordingly, it is an object of the present invention to provide a power tool of the above mentioned type which avoids the disadvantages of the prior art.

In keeping with these objects and with others which will become apparent hereinafter, one feature of present invention resides, briefly stated in a power tool which has a plurality of screw members which are screwable in the element and are arranged around an axis so as to be spaced from one another, each of the screw members having a first end adapted to interact with an object and an opposite second end; and drive means including an action drive and a reaction drive arranged coaxially to the axis and with one another and turnable in opposite directions, one of the drives engaging an outer circumference of the screw members while the other of the drives engaging an inner circumference of the screw members so that when the power tool is activated the drives are turned in opposite directions and turn the screw members in one and the same direction to thereby move the element in the axial direction.

The present invention also deals with a method, in accordance with which a plurality of screw members are screwable in an element, for example in a nut on one bolt end, and arranged around an axis so as to be spaced from one another, a first end of each screw member is adapted to abut against an object, and the screw members are engaged by coaxial oppositely turning action and reaction drives with one of the drives engaging an outer circumference and the other drive engaging an inner circumference of the screw members, so that when the drives are turned in opposite directions the screw members turn in one and the same direction to thereby move the element in an axial direction.

When the power toot is designed and the method is performed in accordance with the present invention, opposite turning forces of the action drive and the reaction drive of the power tool are applied simultaneously to one or several members, so as to turn them in the same direction. The action force of the tool is applied to one circumferential side of the screw members, whereas the reaction force of the tool is applied to the other circumferential side to the screw members. No longer a side load, a torsion or a bending force is applied to the element. When the screws are screwed into element, the element will have to move axially. The simultaneous turning of both the action drive and reaction drive also eliminates any type of tool reaction being transferred to the tool operator's hand, simply because both either turn or stop.

In accordance with another feature of the present invention, each screw member is provided with a gear so that a ring of gears is formed, and the drives engages the outer and inner circumferences of the ring of gears.

In accordance with still another feature of the present invention, each gear is composed of two axially spaced gear portions having different gear characteristics and engaged by the corresponding drives. Since in the outer circumference of the ring of gears is larger than the inner circumference of the ring of gears, the use of a single gear at the end of each screw member will result in a different turning speed between action and reaction drives. By using of two gear portions having different gear characteristics, the turning speeds of the action and reaction drives can be adjusted correspondingly.

The novel features which are considered as characteristic for the present invention are set forth in particular in the appended claims. The invention itself, however, both as to its construction and its method of operation, together with additional objects and advantages thereof, will be best understood from the following description of specific embodiments when read in connection with the accompanying drawings.

DESCRIPTION OF PREFERRED EMBODIMENTS

Figure 1:
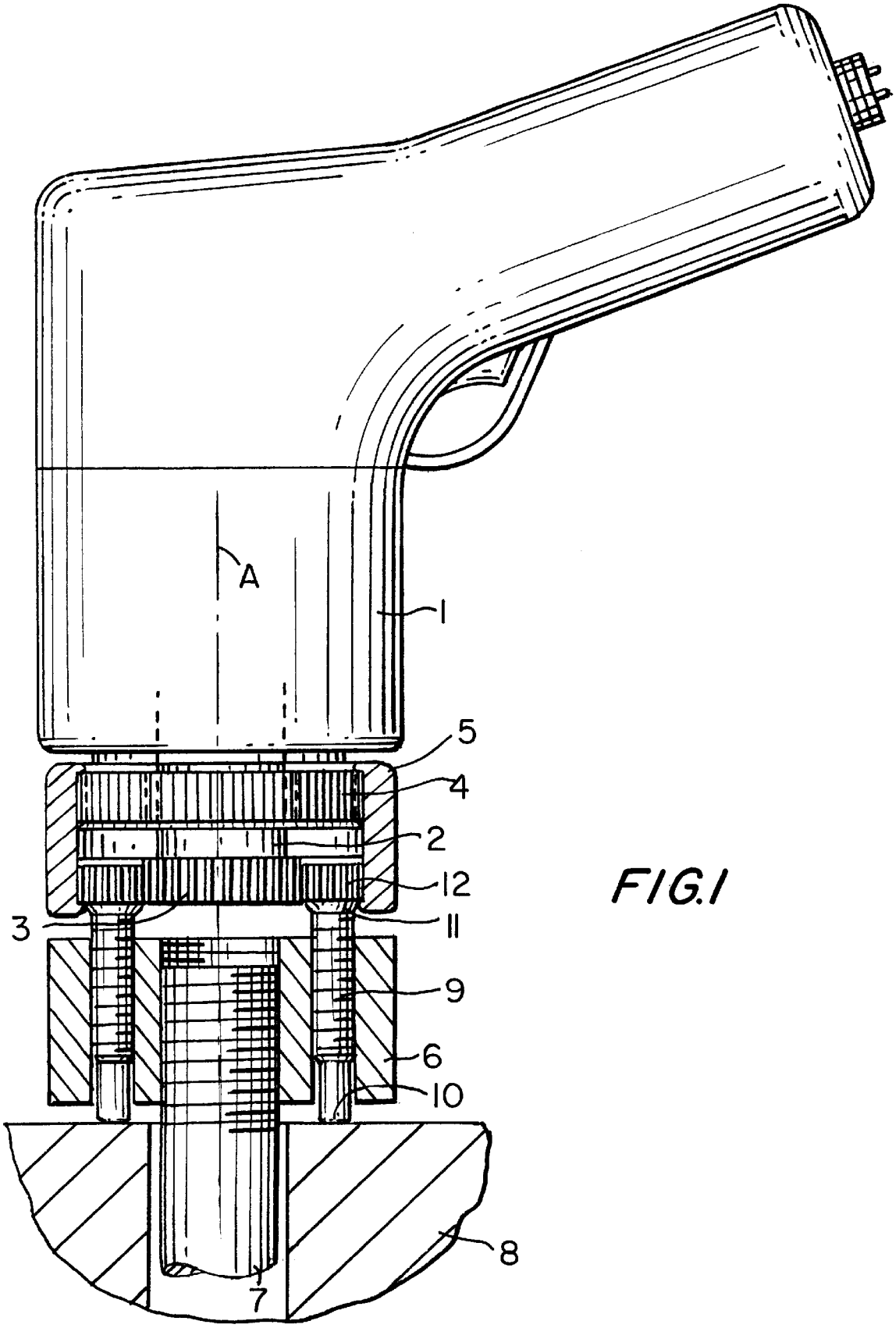
FIG. 1 is a view showing a power tool in accordance with the present invention.

A power tool in accordance with the present invention which operates in accordance with the inventive method has a housing which is identified as a whole with reference numeral 1. A not shown main drive unit is accommodated in the housing 1 and can be formed for example as a fluid-operated cylinder-piston unit provided for example with an outer turning element for producing a turning action.

The power tool is provided with an action drive and a reaction drive. One of said drives includes a central shaft 2 which is connected with the turning element of the main drive unit. At the opposite end the shaft 2 is connected with a central gear 3 having outer teeth. The other drive includes a central disc 4 provided with outer engaging formations formed for example as splines, and an annular member 5 having inner splines engaging with the outer splines of the central disc 4. The shaft 2 extends centrally through the central disc 4 with a gap therebetween to permit independent rotation of the shaft 2 and the central disc 4 relative to one another. The central disc 4 can be fixedly connected to the housing 1. The drives 2, 3 and 4, 5 are coaxial with one another and with a central axis A.

The power tool in accordance with the present invention is used for providing an axial movement of an element relative to an object. In the shown embodiment of FIG. 1 the element is represented by a nut 6 which is screwed on a bolt 7 extending through an object 8, for example a flange and the like. A plurality of screws 9 are screwed in threaded openings of the nut 6 and are spaced from one another in a circumferential direction around the axis A. Each screw has a first end 10 adapted to directly or indirectly interact with the object 8, for example to abut against the object 8, to engage the object 8, to abut against a washer located between the element 6 and the object 8, etc., and an opposite other end 11.

The drive 2, 3 is arranged to engage the screws 9 inwardly on the inner side, while the drive 4, 5 is arranged to engage the screws 9 outwardly on the outer side. For this purpose, at a location axially spaced from the first end 10 toward the other end 11, each screw 9 is provided for example with at least one gear 12. The gears 12 are spaced from one another circumferentially around the axis A and together form a ring or set of gears.

As can be seen from the drawings, the central gear 3 of the first drive 2, 3 engages the ring of the gears 12 inwardly on the inner circumference, or in other words engages each of the gears 12 at its radially inner side. The annular member 5 of the other drive 4, 5 engages the outer circumference of the ring of gears, or in other words engages each gear 12 at its radially outer side.

The power tool in accordance with the present invention as defined in claim 1 operates in the following manner.

When the power tool is activated, the main drive unit causes turning of the shaft 2 in one direction, through the not shown turning element, and therefore also turns the central gear 3 of the first drive 2, 3. As a result of a reaction force, the housing 1 of the tool turns in an opposite direction and thereby turns the central disc 4, which in turn, turns the annular member in the opposite direction. As a result, the gears 12 are turned in one and the same direction under the action of turning forces applied radially outwardly and radially inwardly to each gear 12. In response to the turning of the gears 12, the screws 9 are displaced axially toward the object or away from the object, depending on the direction of rotation, displace the nut 6 axially and therefore to tighten or loosen the bolt 7 in the object 8.

Figure 2:
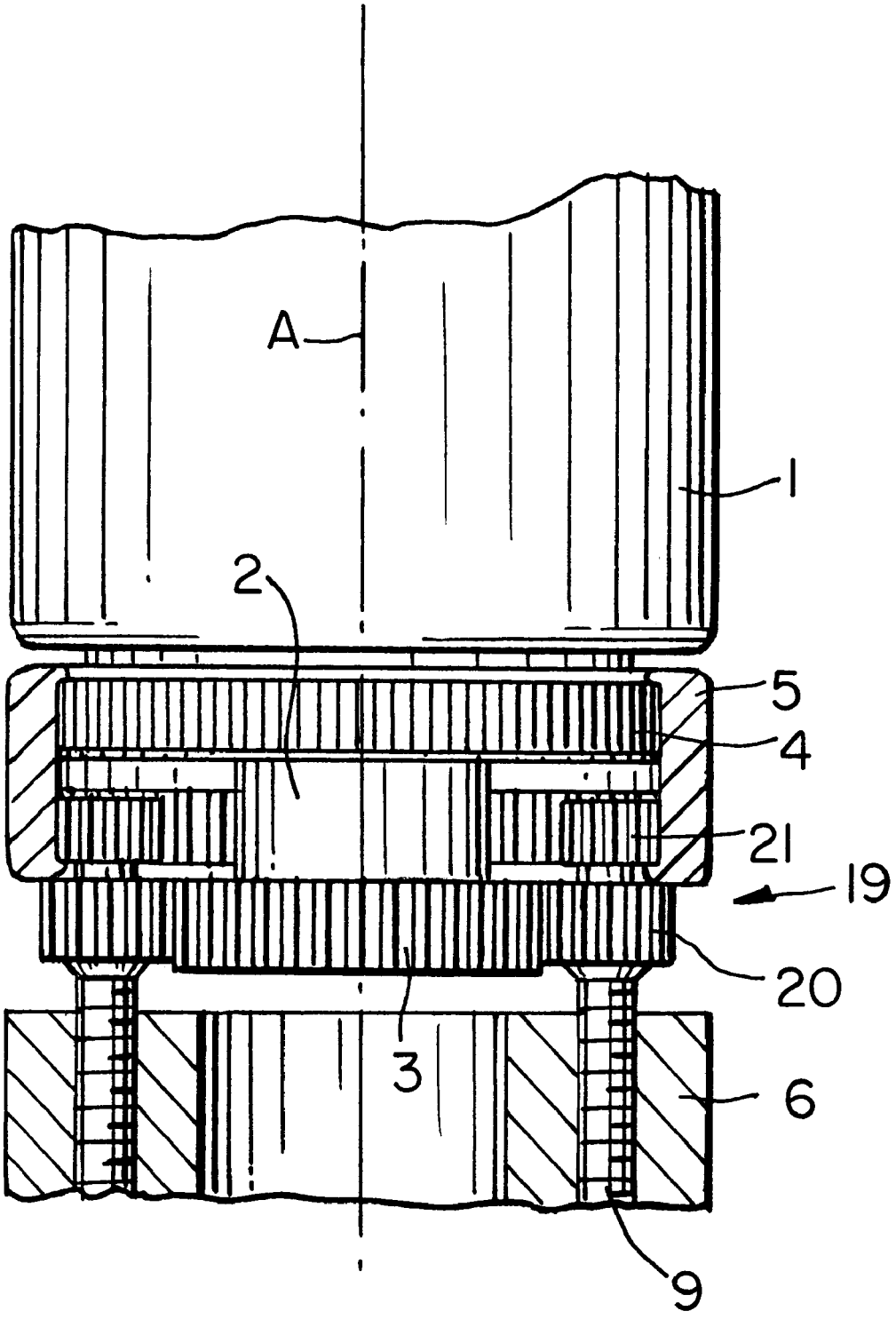
FIG. 2 is a view showing a further embodiment of the inventive power tool.

FIG. 2 shows another embodiment of the present invention. The parts of the power tool shown in FIG. 2 which are similar to the parts of power tool shown in FIG. 1 are identified with the same reference numerals. The gears of the power tool of this embodiment are formed differently. Each gear 19 has two gear members 20 and 21 which are spaced from one another in an axial direction. The gear member 20 of each gear 19 is engaged by the central gear 3 of the drive 2, 3, while the gear member 21 of each gear 19 is engaged by the annular member 5 of the drive 4, 5. The gear member 20 and 21 of the same gear 19 have different gear characteristics for example different diameters, different numbers of teeth, different pitches, etc. These different gear characteristics can be selected so as to adjust the speed of turning of the drives 2, 3 and 4, 5.

Figure 3:
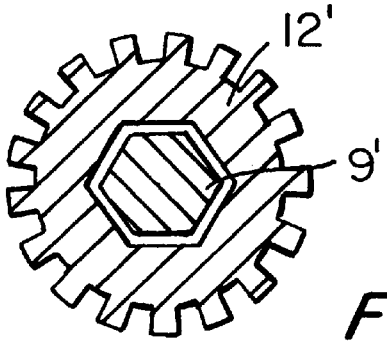
FIG. 3 shows a detail of the inventive power tool.

It is of course not necessary to make the gears 12 or 19 integrally with the corresponding screws 9. As shown in FIG. 3, a gear 12' is formed as a separate member. It is provided with an inner polygonal opening and mounted on a polygonal projection of a screw 9'.

Figure 4:
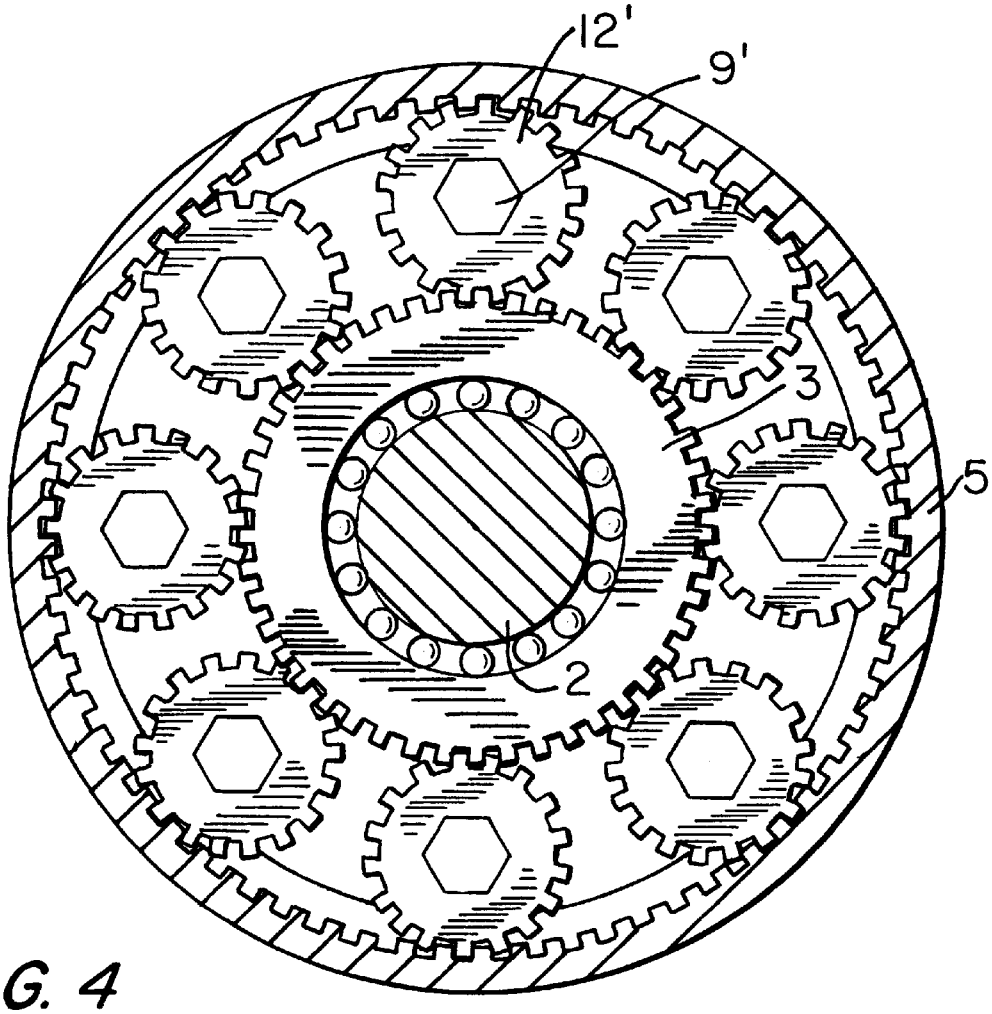
FIG. 4 shows an assembly composed of several parts of the inventive power tool.

Several parts of the inventive power tool can form together a single unit which is shown in FIG. 4. The gears 12' are rotatably affixed between the central gear 3 and the annular member 5. When the annular member 5 is mounted on the central disc 4, the central gear 3 simultaneously mounts on the central shaft 2. The power tool together with the thusly assembled unit is now applied to the polygonal screws 9'.

It is to be understood that some modifications are possible. For example, the shaft 2 can be immovably connected with the housing of the tool, while the central gear 4 can be tunable by a turning element of the tool.

The annular member 5 can be immovably connected with the housing, and the central disc 4 can be eliminated.

Since the inventive power tool can be used for displacing the elements (nuts, bolts, etc.) of different diameters relative to the object, corresponding parts of the tool can be made removable and exchangeable by similar parts having different diameters. For example, the central gear 3 instead of being integral with the shaft 2, can be removably mounted on the shaft by interengaging polygonal formations and the like, and replaced by central gears of different diameters when needed. The central disc 4 and/or the annular member 5 can be removably mounted to the housing and replaceable by the central discs and/or annular members of different diameters.

It will be understood that each of the elements described above, or two or more together, may also find a useful application in other types of constructions differing from the types described above.

While the invention has been illustrated and described as embodied in a power tool for moving an element, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims:

1. A power tool for moving an element in an axial direction relative to an object, comprising a plurality of screw members which are screwed in threaded openings of the element and are arranged around an axis so as to be spaced from one another, each of said screw members having a first end adapted to interact with the object and an opposite second end; and drive means including an action drive and a reaction drive arranged coaxially to said axis and with one another and turnable in opposite directions, either of said action drive or reaction drive engaging an outer circumference of said screw members while the other of said action drive or reaction drive engaging an inner circumference of said screw members so that when the power tool is activated said drives are turned in opposite directions and turn said screw members in one and the same direction to thereby move the element in an axial direction.

2. A power tool as defined in claim 1, wherein each of said screw members is provided with at least one gear so as to form a ring of gears, said drives engaging an outer circumference and an inner circumference of said ring of gears correspondingly.

3. A power tool as defined in claim 2, wherein each of said gears has a first gear member and a second gear member spaced from one another in an axial direction and having different gear characteristics so as to adjust turning speeds of said action drive and said reaction drive.

4. A power tool as defined in claim 2, wherein said one drive includes an annular member having a portion which engages each of said gears from outside.

5. A power tool as defined in claim 4, wherein said one drive further has a central disc which inwardly engages said annular member at an axial location spaced from a location at which said annular member engages said gears from outside.

6. A power tool as defined in claim 2, wherein said other drive includes a central gear which engages each of said gears from inside.

7. A power tool as defined in claim 6, wherein said other drive also has a central shaft which is connected with said central gear.

8. A power tool as defined in claim 5, wherein said other drive also has a central shaft and a central gear which engages each of said gears from inside, said central shaft extending freely through said disc with a radial distance therebetween and being located inside said annular member.

9. A method of moving an element in an axial direction relative to an object by a power tool, comprising the steps of screwing a plurality of screw members into threaded openings of the element; interacting by one end of the screw members with the object; engaging the screw members by coaxial oppositely turnable action and reaction drives so that one of the said action drive or reaction drive engages an inner circumference and the other of the said action drive or reaction drive engages an outer circumference of the screw members; and turning the drives in opposite directions so as to turn the screw members in one and the same direction and to thereby move the element in an axial direction.

* * * * *